United States Patent [19]

Taniguchi et al.

[11] Patent Number: 4,464,036

[45] Date of Patent: Aug. 7, 1984

[54] METHOD AND APPARATUS FOR CONTROLLING ACTIVITY OF DEVELOPING SOLUTION AGAINST BLACKENING BY USING A TEST PIECE

[75] Inventors: Hiroshi Taniguchi, Uji; Nobuhiro Takita; Norimasa Nomura, both of Kyoto; Masaji Mizuta, Uji, all of Japan

[73] Assignee: Dainippon Screen Seizo Kabushiki Kaisha, Kyoto, Japan

[21] Appl. No.: 395,705

[22] Filed: Jul. 6, 1982

[30] Foreign Application Priority Data

Jul. 20, 1981 [JP] Japan ..... 56-113218
May 24, 1982 [JP] Japan ..... 57-87592

[51] Int. Cl.[3] ..... G03D 3/02

[52] U.S. Cl. ..... 354/324; 430/30; 356/443; 250/559

[58] Field of Search ..... 354/298, 324; 430/30; 356/443, 444; 250/559

[56] References Cited

U.S. PATENT DOCUMENTS 1,895,760 1/1933 Hunt ..... 354/298
3,636,851 1/1972 Furst ..... 354/298
3,995,959 12/1976 Shaber ..... 354/298
4,293,211 10/1981 Kaufmann ..... 354/298
4,365,895 12/1982 Shaber et al. ..... 354/298

*Primary Examiner*—A. A. Mathews
*Attorney, Agent, or Firm*—Daniel M. Rosen

[57] ABSTRACT

A method and apparatus for controlling the activity of a developing solution against blackening by using a test piece for use in an automatic developer are disclosed. A difference between a standard density measured at the predetermined point of the first test piece developed in a standard developing solution, and a density measured at the same point of the second test piece of the same type as the first test piece as said predetermined point of the first test piece, developed in a developing solution to be controlled, is obtained. Then, a predetermined factor is multiplied by the thus obtained density difference to obtain a control value, and then the activity of the developing solution is controlled according to the control value, such as adding a supplementary solution against the blackening to the developing solution to be controlled or putting an exposed film into the same. A permissible density difference range may be determined, in which no activity control is performed.

10 Claims, 2 Drawing Figures

METHOD AND APPARATUS FOR CONTROLLING ACTIVITY OF DEVELOPING SOLUTION AGAINST BLACKENING BY USING A TEST PIECE

BACKGROUND OF THE INVENTION

The present invention relates to a method and apparatus for controllling the activity of a developing solution against blackening by using a test piece for use in an automatic developer.

In a conventional automatic photographic film developer, the activity of the developing solution which is fatigued or lowered by film blackening, has been maintained to the proper value by some methods as follows.

(a) The replenishment of a supplmentary solution against the blackening is carried out depending on a developed area of the photographic film and a predetermined blackening rate.

(b) The supplementary solution is supplemented depending on a blackened area measured of the photographic film.

(c) The supplementary solution is replenished in a certain period of time corresponding to the measured length of the photographic film to be processed, whose predetermined unit length requires the supplement of a certain volume of the supplementary solution.

The developing solution is also fatigued by oxidation by means of the air, and the like. The degree of the oxidation of the developing solution is different between during and in the absence of the operation of the automatic developer. Hence, in general, the amount of the supplementary solution per unit period of time should be varied during and in the absence of the operation of the developer.

However, as such an activity control of the developing solution is continued, the control errors are accumulated. Accordingly, the activity of the developing solution must be further controlled, for example, twice a day by using a test piece.

In a conventional activity control method of the developing solution against the blackening, the test pieces exposed with the certain light and shade are processed in the standard developing solution and the developing solution whose activity is to be controlled, separately, and then the densities at the predetermined light and shade points of the developed test piece processed in the developing solution to be controlled are compared with those of the test piece processed in the standard developing solution with the naked eye or a densitometer. Then, depending on the difference of these densities, the supplementary solution is added or an exposed useless film is put in the developing solution to be controlled on the basis of the operator's experiences and skill, in order to raise or lower the activity of the developing solution.

In this method, however, the determination of the exact amount of the supplementary solution corresponding to the density difference of the two test pieces is very difficult. Accordingly, in practice, the supplementary solution is usually added in a somewhat smaller amount in a manual manner, and then the activity of the developing solution is measured by using the test piece. When its activity is lower than the standard range, the supplementary solution is added. When its activity is higher than the standard range, i.e. the fresh developing solution is oversupplied, exposed useless films are put therein several times, thereby obtaining a proper activity. However, this operation is very troublesome and involves a lot of time.

SUMMARY OF THE PRESENT INVENTION

It is an object of the present invention to provide a method for controlling the activity of a developing solution against blackening by using a test piece for use in an automatic developer, free from the aforementioned inconveniences and disadvantages, which is simple, quick and reliable, and need not any skill.

It is further object of the present invention to provide an apparatus for controlling the activity of a developing solution against blackening by using a test piece for use in an automatic developer, free from the aforementioned inconveniences and disadvantages, which is capable of performing a simple, quick and reliable operation without any skill.

According to the present invention there is provided a method for controlling the activity of a developing solution against blackening by using a test piece for use in an automatic developer, comprising the steps of (a) obtaining a difference between a standard density measured at the predetermined point of the first test piece developed in a standard developing solution, and a density measured at the same point of the second test piece of the same type as the first test piece as said predetermined point of the first test piece, which is developed in a developing solution to be controlled, (b) multiplying a predetermined factor by the thus obtained density difference to obtain a control value, and (c) controlling the activity of the developing solution according to the control value such as by adding a supplementary solution to the developing solution to be controlled or putting an exposed film into the developing solution to be controlled.

According to the present invention there is also provided an apparatus for controlling the activity of a developing solution against blackening by using a test piece for use in an automatic developer, comprising (a) the first density setup means which sets up a standard density N at the predetermined point of the first test piece which is developed in a standard developing solution, (b) the second density setup means which sets up a density N′ measured at the same point of the second test piece of the same type as the first test piece as said predetermined point of the first test piece, which is developed in a developing solution to be controlled, (c) the first factor setup means which sets up the first blackening factor $K_1$ satisfying a formula $T=K_1(N-N')$, wherein T means an operating time of constant-flow supplementary solution adding means which supplements the supplementary solution to the developing solution to be controlled in order to restore the lowered activity to the predetermined value, (d) a second factor setup means which sets up the second blackening factor $K_2$ satisfying a formula $A=-K_2(N-N')$, wherein A means a surface area of the exposed film which is put into the developing solution to be controlled in order to reduce the overvalued activity to the predetermined value, (e) a density comparator which compares the two densities N and N′ which are set up in the first and the second setup means, to discriminate the magnitude and outputs a negative or positive signal depending on the magnitude, (f) a subtracter which receives the densities N and N′ from the first and the second setup means and calculates a density difference N-N′, (g) a first multiplier which is driven by a positive signal generated by the density comparator and which receives the subtraction result of the subtracter and the first blackening factor from the first factor setup means, and calculates $K_1(N-N')$ to obtain the operating time T, (h) constant-flow supplementary solution adding means which adds the supplementary solution to the developing solution to be controlled for the operating time T by the output of the first multiplier, (i) a second multiplier which is driven by a negative signal generated by the density comparator and which receives the subtraction result of the subtracter and the second blackening factor from the second factor setup means, and calculates $-K_2(N-N')$ to obtain the surface area A of the exposed film, and (j) a display which displays the result of the second multiplier.

BRIEF DESCRIPTION OF DRAWINGS

In order that the present invention may be better understood, preferred embodiments thereof will be described with reference to the accompanying drawings, in which.

DESCRIPTION OF THE PREFERRED EMBODIMENTS

Figure 1:
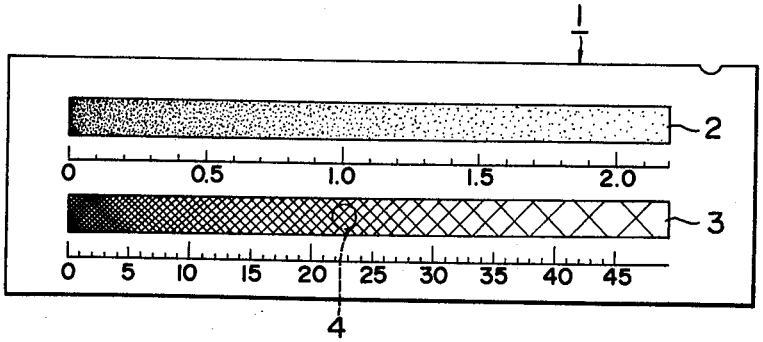
FIG. 1 shows one example of a test piece used in the present invention.

Referring to the drawings, there is shown in FIG. 1 one example of a test piece 1 which is exposed under certain conditions and is processed in a standard developing solution, having a continuous tone zone 2 and a halftone dot zone 3. The density is measured at a point 4 of the halftone dot zone 3, having a halftone dot area rate of 50%, by a densitometer 5 to obtain a standard density N. Another test piece 1 of the same type as the above described test piece 1 is processed in a developing solution to be controlled, and its density at the same point as the above test piece 1 is measured to obtain a density N'.

Then, according to the present invention, the activity of the developing solution to be controlled is controlled by a computer or a processor, such as automatically adding the supplementary solution against the blackening to the developing solution to be controlled according to the following formula (1) in order to restore the developeing activity, or putting an exposed useless film into the developing solution to be controlled according to the following formula (2) in order to reduce the developing activity.

$$T=K_1\times(N-N') \quad (1)$$

$$A=-K_2\times(N-N') \quad (2)$$

In these formulae, T means an operating time of constantflow supplementary solution adding means, A means a surface area of the exposed film, and $K_1$ and $K_2$ are blackening factors determined depending on the test piece used, the developing solution to be controlled, the supplementary solution, the density measuring position of the test piece, the flow speed of the supplementary solution adding means, kinds of the useless films, and so forth. The density measuring point is determined in the continuous tone zone 2 at the corresponding position to that of the halftone dot zone 3.

Figure 2:
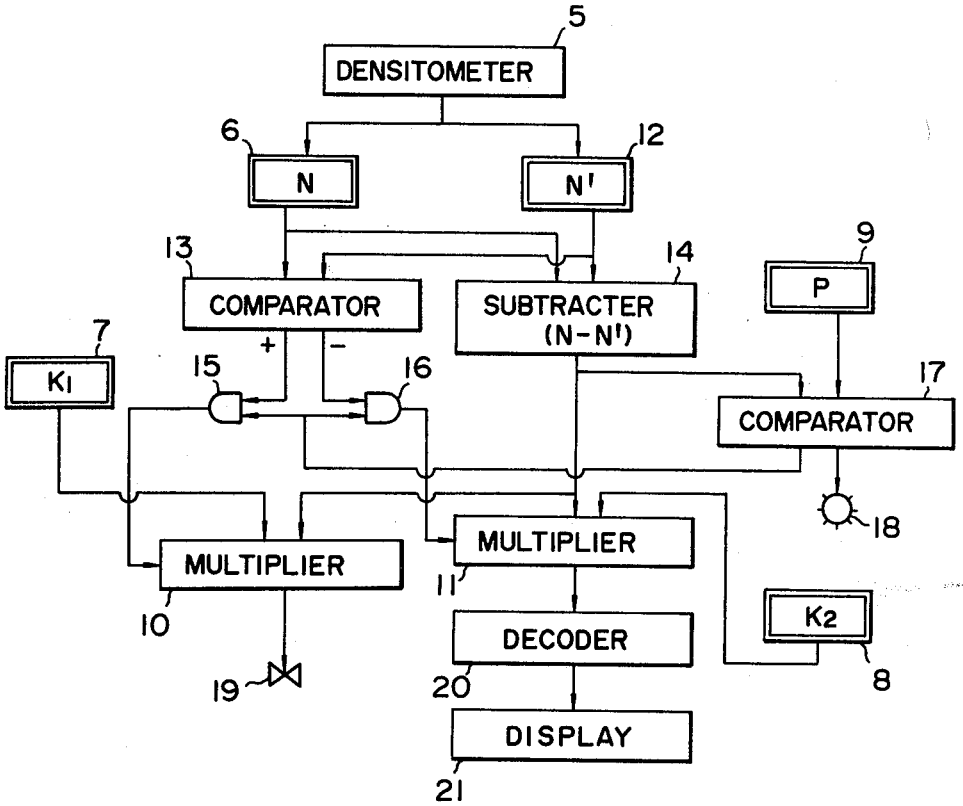
FIG. 2 is a block diagram of one embodiment of an apparatus according to the present invention.

In FIG. 2 there is shown one embodiment of an apparatus according to the present invention.

The standard density N, and the first and the second blackening factors $K_1$ and $K_2$ are set up in a standard density setup means 6, and first and second blackening factor setup means 7 and 8, respectively, in advance.

A permissible range P of the density difference N-N', in which no control of the activity of the developing solution to be controlled is carried out since the difference between the standard density N and the measured density N' is small enough, is set up in a permissible density difference range setup means 9 in advance.

The formulae (1) and (2) are stored in the first and the second multipliers 10 and 11.

The density N' measured by the densitometer 5 is set up in a measured density setup means 12, and the standard density N and the measured density N' are fed to a density comparator 13 and a subtracter 14.

In the density comparator 13, the magnitude of the two densities N and N' is compared for determining whether to supplement or put an exposed useless film into the developing solution to be controlled. The comparative outputs a positive or a negative signal to the first gate 15 or the second gate 16. The subtracter 14 calculates the density difference N-N', and the subtraction result is sent to the first and the second multipliers 10 and 11 and a range comparator 17.

The range comparator 17 compares the density difference N-N' with the permissible density difference range P fed from the permissible density difference range setup means 9, and it illuminates a lamp 18 when the density difference N-N' is within the permissible range P, i.e. $P_{max}>N-N'>P_{min}$, opens the first gate 15 when $N-N'>P_{max}$, or opens the second gate 16 when $N-N'<P_{min}$.

When the first gate 15 is opened, the first multiplier 10 is driven by the signal passing through the first gate 15, and performs the calculation $T=K_1(N-N')$. Then, a constant-flow solenoid valve 19 is opened for the operation time T by the output of the first multiplier 10 in order to supplement the desired amount of the supplementary solution to the developing solution to be controlled, thereby restoring the activity of the developing solution to the predetermined value.

On the other hand, when the second gate 16 is opened, the second multiplier 11 is driven by the signal passing through the second gate 16, and performs the calculation $A=-K_2(N-N')$. Thus the obtained result is sent to a display 21 through a decoder 20, and the display 21 displays the surface area A. According to this surface area A, an exposed useless film having the surface area A is put into the developing solution to be controlled in order to reduce the activity of the developing solution, thereby maintaining the activity of the developing solution to the predetermined value.

According to the present invention, the control of the activity of the developing solution against the blackening can be performed mechanically and quickly without need of any skill, which is a great advantage and improves the rate of operation very much.

At an exit of a dryer of an automatic developer, a test piece detector such as a microswitch, temporary stop means for a film transfer, which is actuated by the test piece detector, and a densitometer 5 may be disposed, thereby measuring the density of the test piece automatically. Thus the measured density is input to the apparatus of the present invention.

Alternatively, the density of the test piece developed is measured manually at a proper position, and the measured density may be input to the apparatus of the present invention.

Although the density of the test piece is measured at the point of the halftone dot area rate of 50% because of the easy and exact measurement, however, it may be done at a point having a halftone dot area rate of 75%, or any other points.

According to the present invention a constant-flow pump, or other proper constant-flow supplementing means can be used instead of the constant-flow solenoid valve 19.

Although the present invention has been described in some detail by way of illustration and example for purposes of clarity of understood, it will, of course, be understood that various changes and modifications thereof may be made in the form, details, and arrangements of the parts without departing from the scope of the present invention.

What is claimed is:

1. A method for controlling the activity of a developing solution against blackening by using a test piece for use in an automatic developer, comprising the steps of:

(a) obtaining a difference between a standard density measured at a predetermined point of a first test piece developed in a standard developing solution, and a density of a second test piece of the same type as the first test piece measured at a point corresponding to said predetermined point of the first test piece, said second test piece being developed in a developing solution to be controlled;

(b) multiplying the thus obtained density difference by a predetermined factor to obtain a control value; and (c) controlling the activity of the developing solution according to said control value by adding supplementary solution to the developing solution to be controlled when the standard density of the second test piece is smaller than the density of the first test piece.

2. A method for controlling the activity of a developing solution against blackening by using a test piece for use in an automatic developer, comprising the steps of:

(a) obtaining a difference between a standard density measured at a predetermined point of a first test piece developed in a standard developing solution, and a density of a second test piece of the same type as the first test piece as said predetermined point of the first test piece, and measured at a point corresponding to said predetermined point of said first test piece, said second test piece being developed in a developing solution to be controlled;

(b) multiplying the thus obtained density difference by a predetermined factor to obtain a control value; and (c) controlling the activity of the developing solution according to said control value by putting an exposed film into the developing solution to be controlled when the standard density of the second test piece is larger than the density of the first test piece.

3. A method as defined in claim 1, comprising determining said factor as a function of the time required for a determined constant flow of the supplementary solution to control the developing solution to be controlled against blackening, when supplemntary solution is added to the developing solution to be controlled.

4. A method as defined in claim 2, comprising determining said factor as a function of the surface area of the exposed film, to control the developing solution to be controlled against blackening when the exposed film is put into the developing solution to be controlled.

5. A method as defined in claim 3, wherein said step of controlling the activity of the developing solution is performed only when the density difference is out of a predetermined range.

6. A method as defined in claim 4, wherein said step of controlling the activity of the developing solution is performed when the density difference is out of a predetermined range.

7. An apparatus for controlling the activity of a developing solution against blackening by using a test piece for use in an automatic developer, comprising:

(a) a first density setup means for inputting a standard density N at a predetermined point of a first test piece developed in a standard developing solution;

(b) a second density setup means for inputting a density N' of a second test piece of the same type as the first piece at a point corresponding to said predetermined point of the first test piece, said second test piece being developed in a developing solution to be controlled;

(c) a first factor setup means for inputting a first blackening factor $K_2$ satisfying a formula $A = K_2(N-N')$, wherein T is an operating time of a constant-flow supplementary solution adding means for adding supplementary solution to the developing solution to be controlled in order to restore lowered activity to a predetermined value;

(d) a second factor setup means for inputting a second blackening factor $K_2$ satisfying a formula $A = K_2(N-N')$, wherein A is a surface area of exposed film necessary to put into the developing solution to be controlled in order to reduce overvalued activity to the predetermined value;

(e) a density comparator for comparing the two densities N and N' set up in the first and the second setup means, to discriminate the magnitude and output a negative or positive signal depending on the magnitude;

(f) a subtractor for receiving the densities N and N' from the first and the second setup means and calculating the density difference N-N';

(g) a first multiplier connected to be enabled by the positive signal generated by the density comparator and to receive the subtraction result of the subtractor and the first blackening factor from the factor setup means, and to calculate $K_1(N-N')$ to obtain the operating time T;

(h) constant-flow supplementary solution adding means for adding supplementary solution to the developing solution to be controlled for the operating time T and controlled by the output of the first multiplier;

(i) a second multiplier connected to be enabled by the negative signal generated by the density comparator and receive the subtraction result of the subtractor and the second blackening factor from the second factor setup means, and to calculate $-K_2(N-N')$ to obtain the surface area A of the exposed film; and (j) a display connected to display the output of the second multiplier.

8. An apparatus as defined in claim 7, further comprising:

(a) density difference range setup means for inputting a permissible density difference range $P_{min}$–$P_{max}$ for the density difference N-n';

(b) a range comparator connected to receive the permissible density difference range $P_{min}$–$P_{max}$ from the density difference N-N′ from the subtractor, and to compare the density difference N-N′ with the values $P_{min}$–$P_{max'}$ and to display the comparation result $P_{min}>N\text{-}N'>P_{max'}$ and output a positive or negative signal when the comparison result is $N\text{-}N'>P_{max}$ or $N\text{-}N'<P_{min}$, respectively;

(c) a first gate between the density comparator and the first multiplier, connected to receive the positive signal from the density comparator and the output of the range comparator, and open only when it receives a positive signal from the density comparator and the range comparator; and (d) a second gate between the density comparator and the second multiplier, connected to receive the negative signal from the density comparator and the output of the range comparator, and opens only when it receives a negative signal from the density comparator and the range comparator.

9. An apparatus as defined in claim 7, wherein the constant-flow supplementary solution supplementing means is a constant-flow solenoid valve.

10. An apparatus as defined in claim 8, wherein the constant-flow supplementary solution supplementing means is a constant-flow solenoid valve.

* * * * *

UNITED STATES PATENT AND TRADEMARK OFFICE

CERTIFICATE OF CORRECTION

PATENT NO. : 4,464,036

DATED : August 7, 1984

INVENTOR(S) : Hiroshi Taniguchi, et al.

It is certified that error appears in the above-identified patent and that said Letters Patent is hereby corrected as shown below:

Column 6, line 24, "$K_2$" should read --$K_1$--.

Column 6, line 24, "$A=K_2$" should read -- $T=K_1$--.

Column 6, line 68 "$N-n^1$" should read -- N-N'--.

Signed and Sealed this

*Twelfth* Day of *November 1985*

[SEAL]

*Attest:*

DONALD J. QUIGG

*Attesting Officer*

*Commissioner of Patents and Trademarks*